US011702953B2

(12) United States Patent
Graham et al.

(10) Patent No.: US 11,702,953 B2
(45) Date of Patent: Jul. 18, 2023

(54) ENGINE INSPECTION AND MAINTENANCE TOOL

(71) Applicants: General Electric Company, Schenectady, NY (US); Oliver Crispin Robotics Limited, Altrincham (GB)

(72) Inventors: Andrew Crispin Graham, Badminton (GB); David Scott Diwinsky, West Chester, OH (US); Ton Thu Lang Giang, Liberty Township, OH (US); Wayne Ray Grady, Hamilton, OH (US)

(73) Assignees: General Electric Company, Schenectady, NY (US); Oliver Crispin Robotics Limited, Altrincham (GB)

( * ) Notice: Subject to any disclaimer, the term of this patent is extended or adjusted under 35 U.S.C. 154(b) by 446 days.

(21) Appl. No.: 16/779,837

(22) Filed: Feb. 3, 2020

(65) Prior Publication Data

US 2021/0239010 A1 Aug. 5, 2021

(51) Int. Cl.
*F01D 21/00* (2006.01)
*F01D 5/00* (2006.01)

(52) U.S. Cl.
CPC ..... *F01D 21/003* (2013.01); *F01D 5/005* (2013.01); *F05D 2220/321* (2013.01); *F05D 2220/323* (2013.01); *F05D 2230/72* (2013.01); *F05D 2240/12* (2013.01); *F05D 2260/83* (2013.01)

(58) Field of Classification Search
CPC ..... G01N 21/954; G01N 2291/2693; F01D 21/003; F01D 25/285; G02B 23/24; G02B 23/2476; G02B 23/2484; B64F 5/60; B23Q 9/0042; B23Q 17/2409
See application file for complete search history.

(56) References Cited

U.S. PATENT DOCUMENTS

| | | | | |
|---|---|---|---|---|
| 4,139,822 | A * | 2/1979 | Urich | G01N 27/9006 324/219 |
| 4,367,569 | A | 1/1983 | Harmon | |
| 5,010,221 | A | 4/1991 | Grossman et al. | |
| 5,102,221 | A * | 4/1992 | Desgranges | F01D 21/003 356/241.1 |
| 6,557,228 | B2 | 5/2003 | Gruner | |
| 8,499,622 | B2 | 8/2013 | Gaisnon et al. | |
| 8,726,477 | B2 | 5/2014 | Swiderski et al. | |

(Continued)

*Primary Examiner* — David E Sosnowski
*Assistant Examiner* — Aye S Htay
(74) *Attorney, Agent, or Firm* — Fitch, Even, Tabin & Flannery LLP

(57) ABSTRACT

A tool for performing inspection and/or maintenance operations on an engine defines a longitudinal direction and a tangential direction. The tool includes a base extending along the longitudinal direction and including a body, a first extension member extending from the body in the tangential direction at a first location, and a second extension member extending from the body in the tangential direction at a second location. The second location is spaced from the first location along the longitudinal direction. The tool also includes a pivot member rotatably coupled to the base and moveable between an insertion position in which the pivot member is oriented generally along the longitudinal direction and a deployed position in which the pivot member is oriented away from the longitudinal direction.

13 Claims, 8 Drawing Sheets

(56) References Cited

U.S. PATENT DOCUMENTS

| | | | | |
|---|---|---|---|---|
| 8,770,565 | B2 | 7/2014 | Liu et al. | |
| 9,776,298 | B2 | 10/2017 | Clark et al. | |
| 10,016,864 | B2 | 7/2018 | McMillan et al. | |
| 10,086,424 | B2 | 10/2018 | Carruthers | |
| 10,125,611 | B2 | 11/2018 | Roberts et al. | |
| 2007/0157733 | A1* | 7/2007 | Litzenberg | G01N 29/043 73/620 |
| 2011/0018530 | A1* | 1/2011 | Bousquet | G01N 27/9006 324/240 |
| 2012/0085156 | A1* | 4/2012 | Gaisnon | G01N 29/24 73/112.01 |
| 2018/0156132 | A1* | 6/2018 | Dede | F01D 21/003 |

* cited by examiner

ENGINE INSPECTION AND MAINTENANCE TOOL

FIELD

The present subject matter relates generally to a tool for inspecting and/or performing maintenance operations on an engine, such as a gas turbine engine.

BACKGROUND

Typical gas turbine engines generally include alternating stages of rotor blades and stator vanes arranged within one or more of the compressor(s) of a compressor section of the gas turbine engine and within one or more of the turbine(s) of a turbine section of the gas turbine engine. During inspection and maintenance periods, a radial inner portion of the stages of rotor blades and stator vanes may be inspected using a flexible borescope through an opening in the gas turbine engine and through an air flowpath to the radial inner portion.

In order to view a location between adjacent stages of rotor blades and stator vanes, a relatively small borescope may be utilized. However, with such relatively small borescopes, it may be difficult to control the borescope along the radial inner portion of the adjacent stages of rotor blades and stator vanes.

Accordingly, an inspection tool capable of more consistently inspecting a radial inner portion of adjacent stages of rotor blades and stator vanes within an engine would be useful.

BRIEF DESCRIPTION

Aspects and advantages of the invention will be set forth in part in the following description, or may be obvious from the description, or may be learned through practice of the invention.

In one exemplary embodiment of the present disclosure, a tool for performing inspection and/or maintenance operations on an engine is provided. The tool defines a longitudinal direction and a tangential direction. The tool includes a base extending along the longitudinal direction and including a body, a first extension member extending from the body in the tangential direction at a first location, and a second extension member extending from the body in the tangential direction at a second location. The second location is spaced from the first location along the longitudinal direction. The tool also includes a pivot member rotatably coupled to the base and moveable between an insertion position in which the pivot member is oriented generally along the longitudinal direction and a deployed position in which the pivot member is oriented away from the longitudinal direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended Figs., in which.

DETAILED DESCRIPTION

Figure 1:
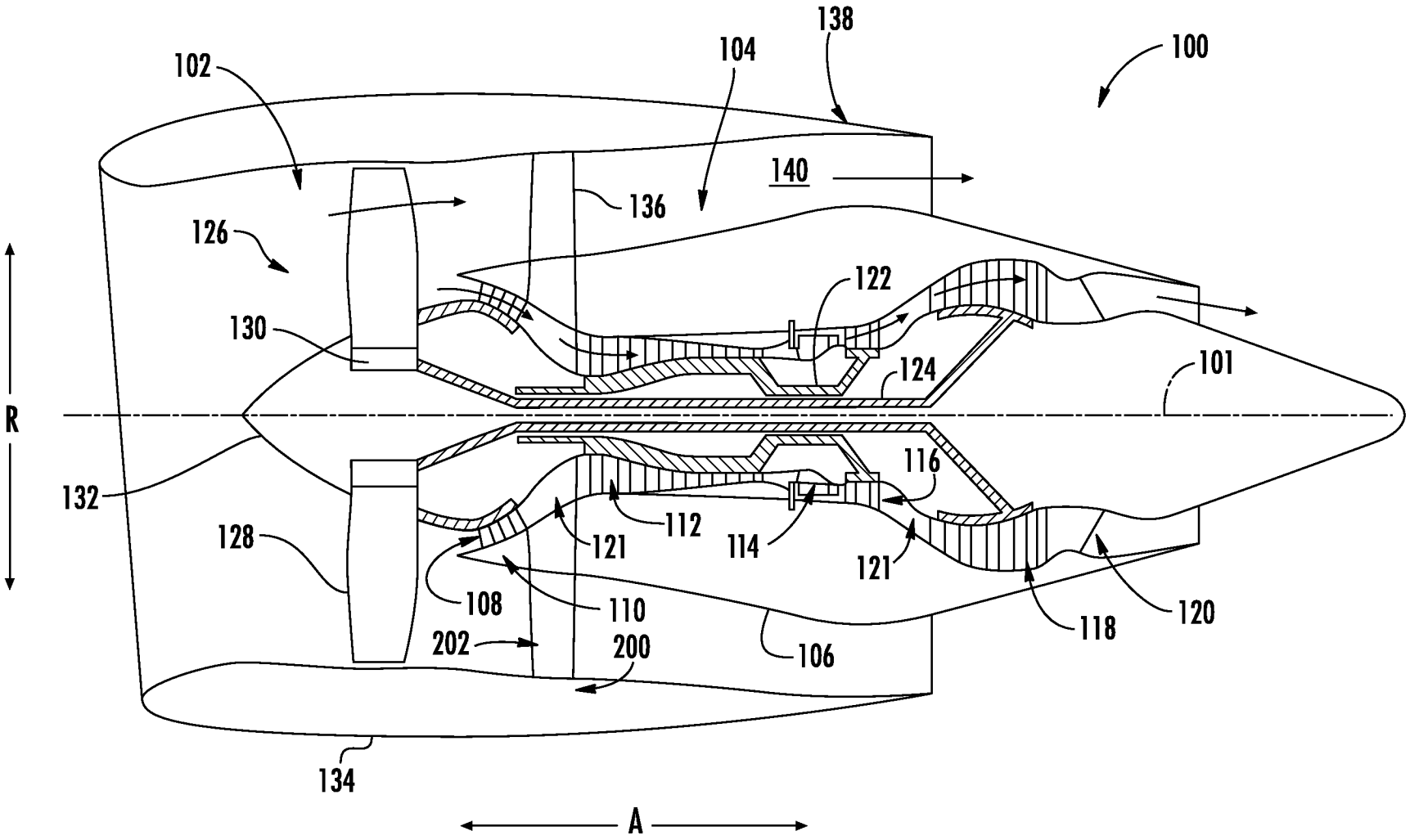
FIG. 1 is a schematic view of a gas turbine engine in accordance with an exemplary embodiment of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components.

The terms "forward" and "aft" refer to relative positions of a component or system, and refer to the normal operational attitude of the component or system. For example, with regard to an extension tool in accordance with one or more the present embodiments, forward refers to a position closer to a distal end of the extension tool and aft refers to a position closer to a root end of the extension tool.

The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Referring now to the drawings, wherein identical numerals indicate the same elements throughout the figures, FIG. 1 provides a schematic, cross-sectional view of an engine in accordance with an exemplary embodiment of the present disclosure. The engine may be incorporated into a vehicle. For example, the engine may be an aeronautical engine mounted on, or incorporated into, an aircraft. Alternatively, however, the engine may be any other suitable type of engine for any other suitable vehicle, or for any other purpose (such as, e.g., power generation, land-vehicle propulsion, fluid pumping stations, etc.).

For the embodiment depicted, the engine is configured as a high bypass turbofan engine 100. As shown in FIG. 1, the turbofan engine 100 defines an axial direction A (extending parallel to a longitudinal centerline 101 provided for reference), a radial direction R, and a circumferential direction (extending about the axial direction A; not depicted in FIG. 1). In general, the turbofan 100 includes a fan section 102 and a turbomachine 104 disposed downstream from the fan section 102.

The exemplary turbomachine 104 depicted generally includes a substantially tubular outer casing 106 that defines an annular inlet 108. The outer casing 106 encases, in serial flow relationship, a compressor section including a booster or low pressure (LP) compressor 110 and a high pressure (HP) compressor 112; a combustion section 114; a turbine section including a high pressure (HP) turbine 116 and a low pressure (LP) turbine 118; and a core jet exhaust nozzle section 120. The compressor section, combustion section 114, and turbine section together define at least in part a core air flowpath 121 extending from the annular inlet 108 to the jet nozzle exhaust section 120. The turbofan engine further includes one or more axial drive shafts. More specifically, the turbofan engine includes a high pressure (HP) shaft or spool 122 drivingly connecting the HP turbine 116 to the HP compressor 112, and a low pressure (LP) shaft or spool 124 drivingly connecting the LP turbine 118 to the LP compressor 110.

For the embodiment depicted, the fan section 102 includes a fan 126 having a plurality of fan blades 128 coupled to a disk 130 in a spaced apart manner. The fan blades 128 and disk 130 are together rotatable about the longitudinal axis 101 by the LP shaft 124. The disk 130 is covered by rotatable front hub spinner 132 aerodynamically contoured to promote an airflow through the plurality of fan blades 128. Further, an annular fan casing or outer nacelle 134 is provided, circumferentially surrounding the fan 126 and/or at least a portion of the turbomachine 104. The nacelle 134 is supported relative to the turbomachine 104 by a plurality of circumferentially-spaced outlet guide vanes 136. A downstream section 138 of the nacelle 134 extends over an outer portion of the turbomachine 104 so as to define an annular fan bypass airflow passage 140 therebetween.

Figure 2:
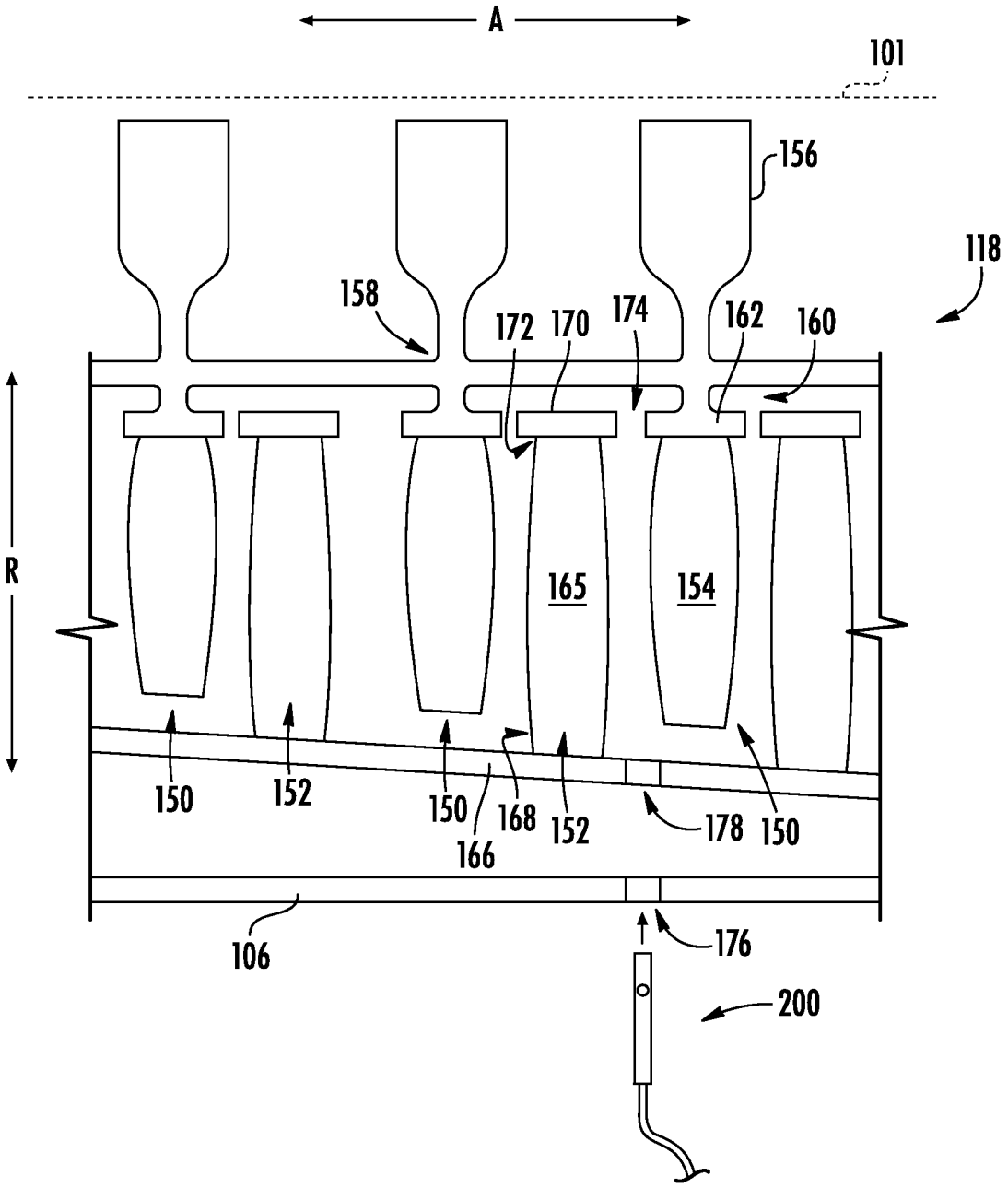
FIG. 2 is a schematic view of a low pressure turbine of an engine in accordance with an exemplary embodiment of the present disclosure.

Referring now to FIG. 2, a schematic view depicted of a compressor or turbine as may be included within the turbofan engine 100 of FIG. 1. Specifically for the embodiment of FIG. 2, a portion of a turbine is provided, and more specifically, a portion of an LP turbine 118 is provided. As with the exemplary compressors and turbines of the turbofan engine 100 of FIG. 1, the exemplary turbine of FIG. 2 generally includes alternatingly stages of rotor blades and stator vanes, or rather, alternatingly stages of turbine rotor blades 150 and stages of turbine stator vanes 152. Each of the plurality of stages of turbine rotor blades 150 generally include a turbine airfoil 154 extending generally along the radial direction R and a rotor 156. Additionally, each of the plurality of stages of turbine rotor blades 150 includes a base 158 coupling the turbine airfoil 154 to the rotor 156 (e.g., through a dovetail connection, or other suitable connection means) at a radial inner end 160 of the turbine airfoil 154, the base 158 including a rotor platform 162 at the radial inner end 160 of the turbine airfoil 154. Similarly, each of the plurality of stages of stator vanes 152 includes a stator airfoil 165 extending generally along the radial direction R. The stator airfoils 165 of the plurality of stages of stator vanes 152 are each coupled to a flowpath casing or liner 166 at a radial outer end 168 of the respective stator airfoil 165 and are further coupled to a stator platform 170 at a radial inner end 172 of the respective stator airfoil 165. As will be appreciated, for the embodiment depicted, the rotor platforms 162 of a particular stage of rotor blades 150 defines a gap along the axial direction A, or an axial gap 174, with the stator platforms 170 of an adjacent stage of stator vanes 152.

As is depicted schematically, and as will be discussed in greater detail below, the present disclosure provides for a tool 200 for performing inspection and/or maintenance operations on the engine, and in particular for performing inspection and/or maintenance operations at, within, or through one or more of the axial gaps 174 between adjacent stages of radial inner rotor platforms 162 and radial inner stator platforms 170. As is indicated, the tool 200 may extend through one or more inspection/maintenance openings 176 within an outer casing 106 of the engine, through one or more inspection/maintenance openings 178 within a flowpath casing or liner 166, or both. These one or more inspection openings 176, 178 may in certain embodiments be configured as borescope openings.

It will be appreciated that although the tool 200 is described in the context of inspecting LP turbine 118, in other embodiments, the tool 200 may be utilized to inspect any other suitable turbine or compressor, such as a high pressure turbine, a high pressure compressor, a low pressure compressor, etc., of the engine 100 described above with reference to FIG. 1 or any other suitable engine (e.g., a turboprop engine, a turboshaft engine, a turbojet engine, a differently configured turbofan engine, etc.).

Figure 3:
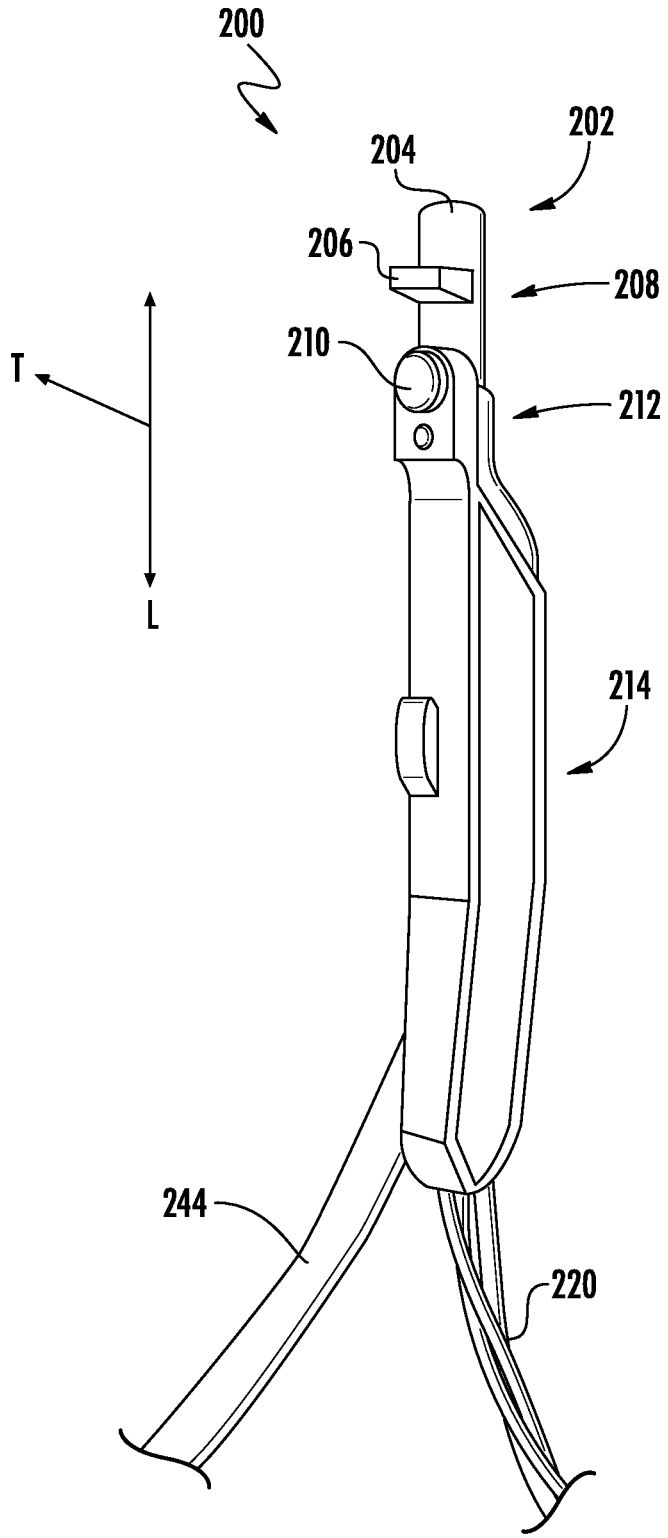
FIG. 3 is a view of a tool for performing inspection and/or maintenance activities within an engine in accordance with an exemplary embodiment of the present disclosure in an insertion position.
Figure 4:
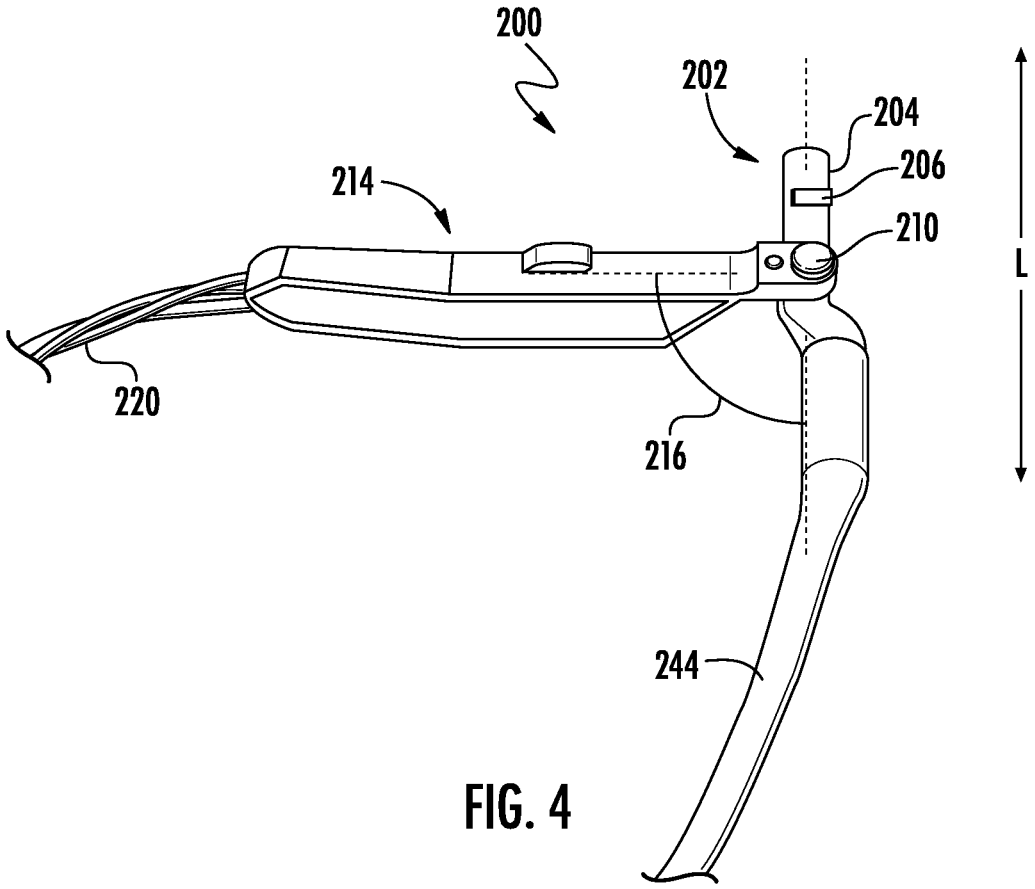
FIG. 4 is a view of the exemplary tool of FIG. 3 in a deployed position.

Referring now to FIGS. 3 and 4, a tool 200 for performing inspection and/or maintenance operations on an engine in accordance with an exemplary embodiment of the present disclosure is provided. In certain exemplary embodiments the exemplary tool 200 of FIGS. 3 and 4 may be the same tool 200 described above with reference FIG. 2 and may be utilized to perform inspection and/or maintenance operations on the turbofan engine 100 described above with reference FIG. 1. However, in other embodiments, the exemplary tool 200 of FIGS. 3 and 4 may be utilized to perform inspection and/or maintenance operations on any other suitable engine.

The exemplary tool 200 generally defines a longitudinal direction L and a tangential direction T (FIG. 3). The tangential direction T is perpendicular to the longitudinal direction L. The exemplary tool 200 depicted includes a base 202 extending along the longitudinal direction L. The base 202 includes a body 204, a first extension member 206 extending from the body 204 in the tangential direction T at a first location 208, and a second extension member 210 extending from the body 204 in the tangential direction T at a second location 212. As will be explained in greater detail below, the second location 212 is spaced from the first location 208 along the longitudinal direction L.

Moreover, for the embodiment depicted, the exemplary tool 200 includes a pivot member 214 rotatably coupled to the base 202 and movable between an insertion position, as is shown in FIG. 3, and a deployed position, as is shown in FIG. 4. In the insertion position the pivot member 214 is oriented generally along the longitudinal direction L of the tool 200. By contrast, in the deployed position the pivot member 214 is oriented away from the longitudinal direction L of the tool 200.

More specifically, for the embodiment shown, the pivot member 214 defines a first angle (FIG. 3, not labeled because it is approximately 0° for the embodiment shown) with the longitudinal direction L when in the insertion position and a second angle 216 with the longitudinal direction L when in the deployed position. For the embodiment shown, the first angle is less than 30° and the second angle 216 is greater than 30°. However, in other embodiments, the first angle may be less than 20°, such as less than 15°, such as less than 10°, such as approximately 0°, as in the embodiment shown. Further, in other embodiments, the second angle 216 may be greater than 45°, such as greater than 60°, such as greater than 75°, such as less than 120°, such as less than 100°, such as approximately 90°, as in the embodiment shown.

In such a manner, the tool 200 may be relatively easily inserted through one or more openings of the engine, such as through one or more borescope opening to the engine.

Figure 5:
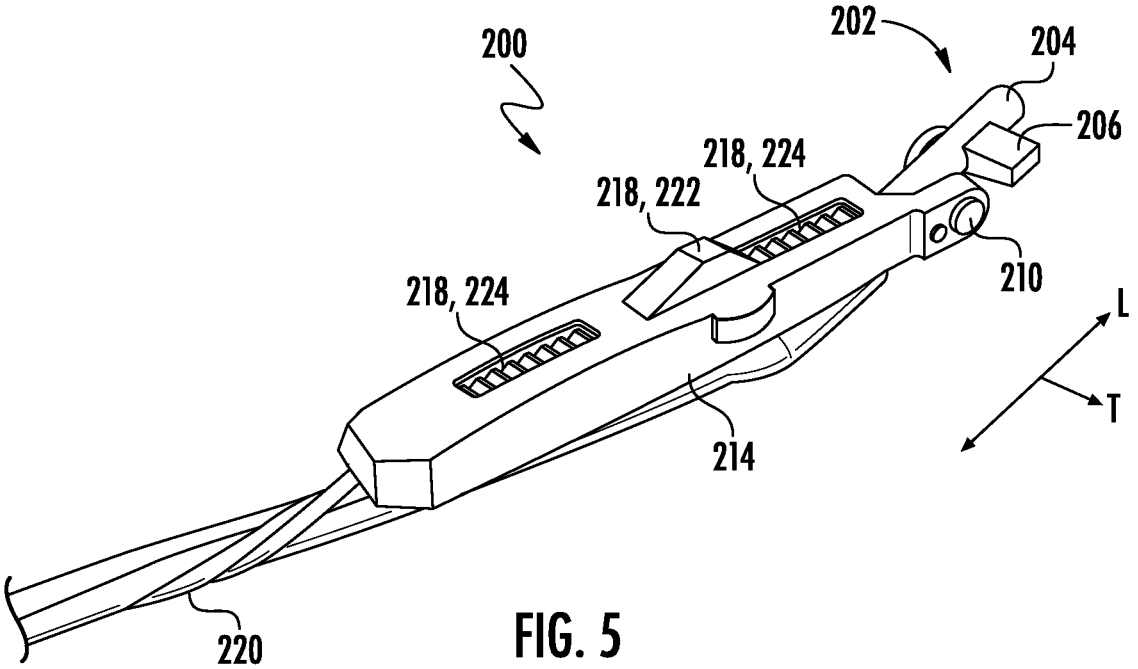
FIG. 5 is a perspective view of the exemplary tool of FIG. 3 in the insertion position.
Figure 6:
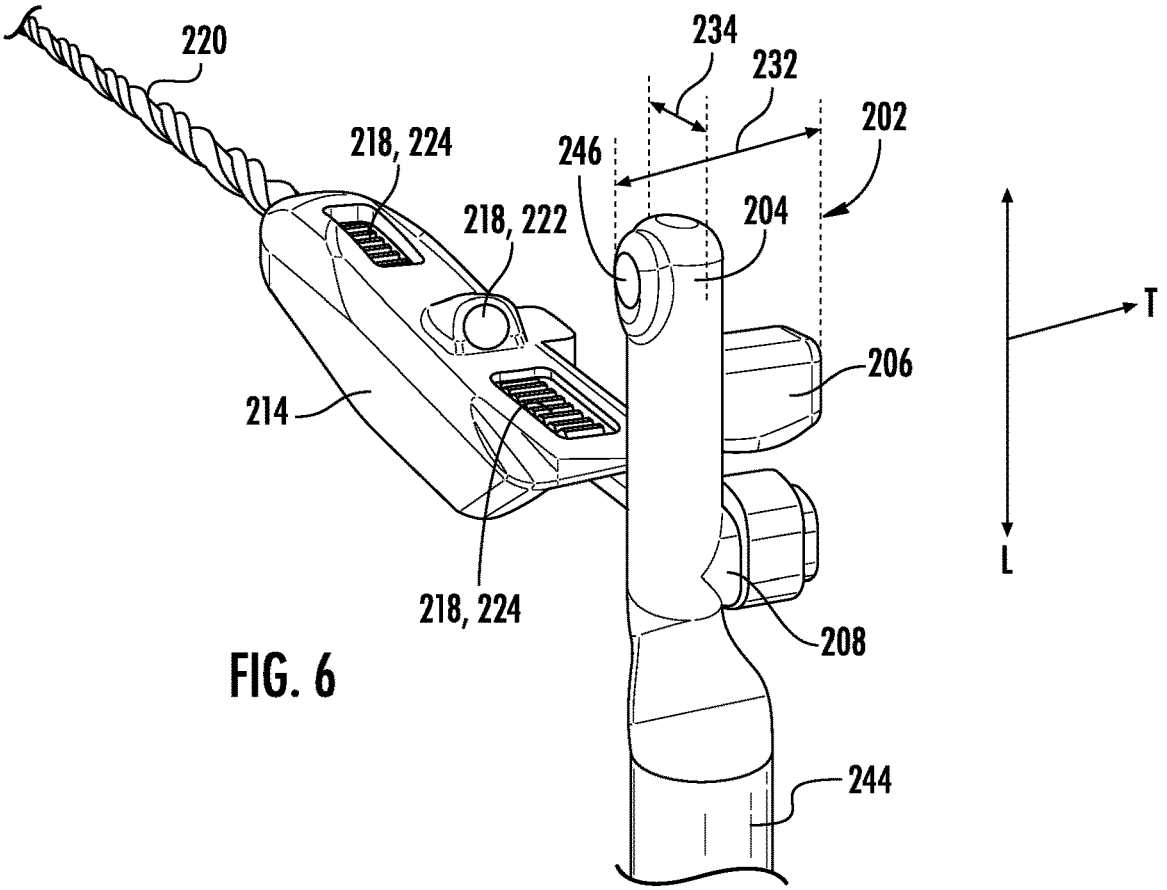
FIG. 6 is a perspective view of the exemplary tool of FIG. 3 in the deployed position.

Referring now also to FIGS. 5 and 6, perspective views of the exemplary tool 200 of FIGS. 3 and 4 are provided. Specifically, FIG. 5 provides a perspective view of the exemplary tool 200 of FIGS. 3 and 4 with the pivot member 214 in the insertion position and FIG. 6 provides a perspective view of the exemplary tool 200 of FIGS. 3 and 4 with the pivot member 214 in the deployed position. From the views depicted in FIGS. 5 and 6, it will be appreciated that the pivot member 214 includes a pivot member implement 218. For the embodiment shown, the tool 200 further includes a wire 220 extending from the pivot member 214, the pivot member implement 218, or both and unconnected to the base 202 of the tool 200. The wire 220 may be, e.g., an electrical wire for providing electrical power to the pivot member implement 218, an electronic communication wire for exchanging electrical communication with the pivot member implement 218, or both. Further, in the context of the wire 220, "unconnected to the base" refers to the wire 220 not being connected to the base, except to the extent that the pivot member 214 is connected to the base 202.

Alternatively, however, the wire 220 may be any suitable line, such as a rope, cable, etc.

Further, as will be appreciated from the discussion herein below, the wire 220 may assist with moving the pivot member 214 from the insertion position to the deployed position, and further may assist with maintaining the tool 200 in position once the pivot member 214 is moved to the deployed position. (See discussion below with reference to FIG. 11.)

More specifically, referring still to FIGS. 5 and 6, the pivot member implement 218 includes a camera 222, a light source 224, or both. More specifically, still, for the exemplary embodiment depicted, the pivot member implement 218 includes both a camera 222 and a light source 224, which for the embodiment shown, is a pair of LED light sources on opposing sides of the camera 222. Notably, the camera 222 is oriented towards the base 202. In such a manner, the tool 200 may provide for images and/or a video feed of the engine proximate the first and second extension members 206, 210 of the base 202 of the tool 200.

In other embodiments, the camera 222 may be oriented generally along the longitudinal direction L, or in any other suitable direction. Further, in other embodiments, the pivot member implement 218 may include a plurality of cameras 222 oriented in any suitable manner.

Figure 7:
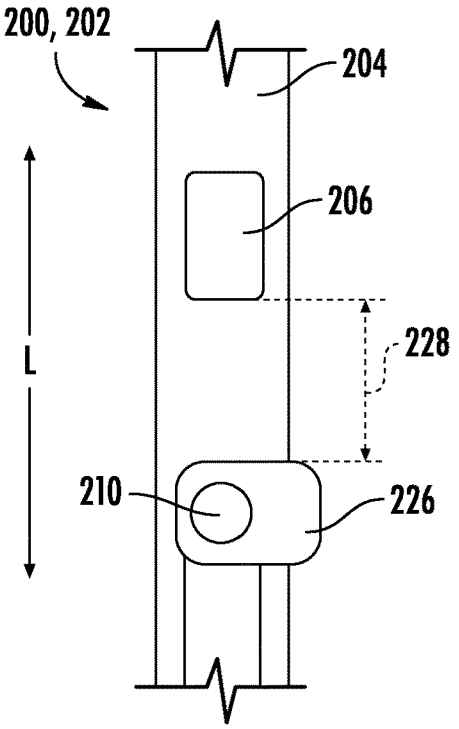
FIG. 7 is a schematic, plan view of the exemplary tool of FIG. 3 in the insertion position.
Figure 8:
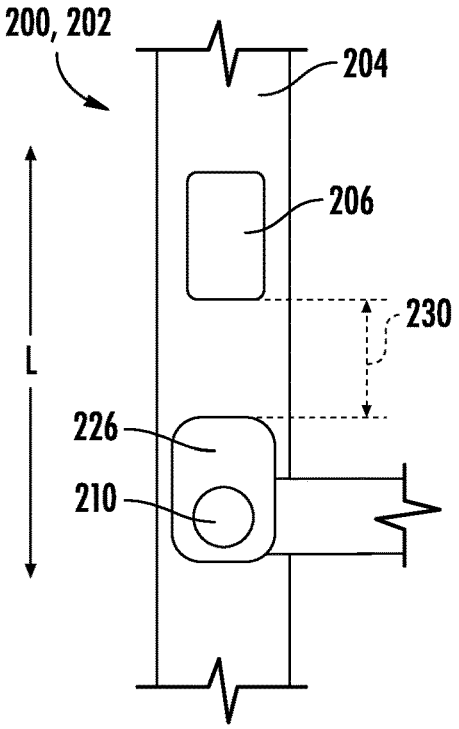
FIG. 8 is a schematic, plan view of the exemplary tool of FIG. 3 in the deployed position.

Referring now particularly to FIG. 6, as well as to FIGS. 7 and 8, it will be appreciated that the exemplary tool 200 is configured to clamp on to a component when the pivot member 214 is moved to the deployed position. More specifically, as will be appreciated from the discussion herein below, the first extension member 206 and second extension member 210 of the tool 200 are configured to clamp onto a component of a rotatable part of the engine when the pivot member 214 is moved to the deployed position (by either directly contacting the component or contacting through one or more intermediate features). FIG. 7 provides a plan view of the tool 200 as viewed along the tangential direction T with the pivot member 214 in the insertion position (see, e.g., FIG. 3), and FIG. 8 provides a plan view of the tool 200 as viewed along the tangential direction T with the pivot member 214 in the deployed position (see, e.g., FIG. 4).

As is shown in the Figures, the pivot member 214 is rotatably coupled to the second extension member 210 of the base 202. More specifically, for the embodiment shown the pivot member 214 includes a sleeve 226 extending at least partially around the second extension member 210 to rotatably couple the pivot member 214 to the second extension member 210. More specifically, still, for the embodiment shown, the sleeve 226 extends completely around the second extension member 210. The sleeve 226 of the exemplary pivot member 214 depicted defines a relatively oblong shape. In such a manner, it will be appreciated that the sleeve 226 defines a first gap 228 with the first extension member 206 along the longitudinal direction L when the pivot member 214 is in the insertion position (see FIG. 7). Further, the sleeve 226 defines a second gap 230 with the first extension member 206 along the longitudinal direction L when the pivot member 214 is in the deployed position (see FIG. 8). The first gap 228 is larger than the second gap 230. Such a configuration, as will be appreciated from the discussion herein below, may allow for the tool 200 to clamp onto the component when the pivot member 214 is moved to the deployed position. (See discussion below with reference to FIGS. 10 and 11.)

Moreover, referring particularly to FIG. 6, it will be appreciated that the exemplary tool 200 is sized to allow for the base 202 of the tool 200 to be inserted at least partially into a relatively narrow area within the engine, as will be appreciated further from the description herein below with reference to, e.g., FIGS. 9 and 10. For example, the base 202 of the tool 200 defines a maximum width 232 along the tangential direction T. The maximum width 232 is generally measured from one side of the body 204 of the base 202, across the body 204, and along a length of the first and second extension members 206, 210. The base 202 of the tool 200 further defines a maximum thickness 234 in a direction perpendicular to the tangential direction T, and perpendicular to the longitudinal direction L. The maximum thickness 234 is generally defined across the body 204 of the base 202. For the embodiment shown, the first extension member 206 is not thicker in this direction than the body 204 of the base 202. For the embodiment shown, the maximum thickness 234 is less than the maximum width 232. In such a manner, the base 202 of the tool 200 may be inserted into a relatively narrow opening in the thickness direction.

Figure 9:
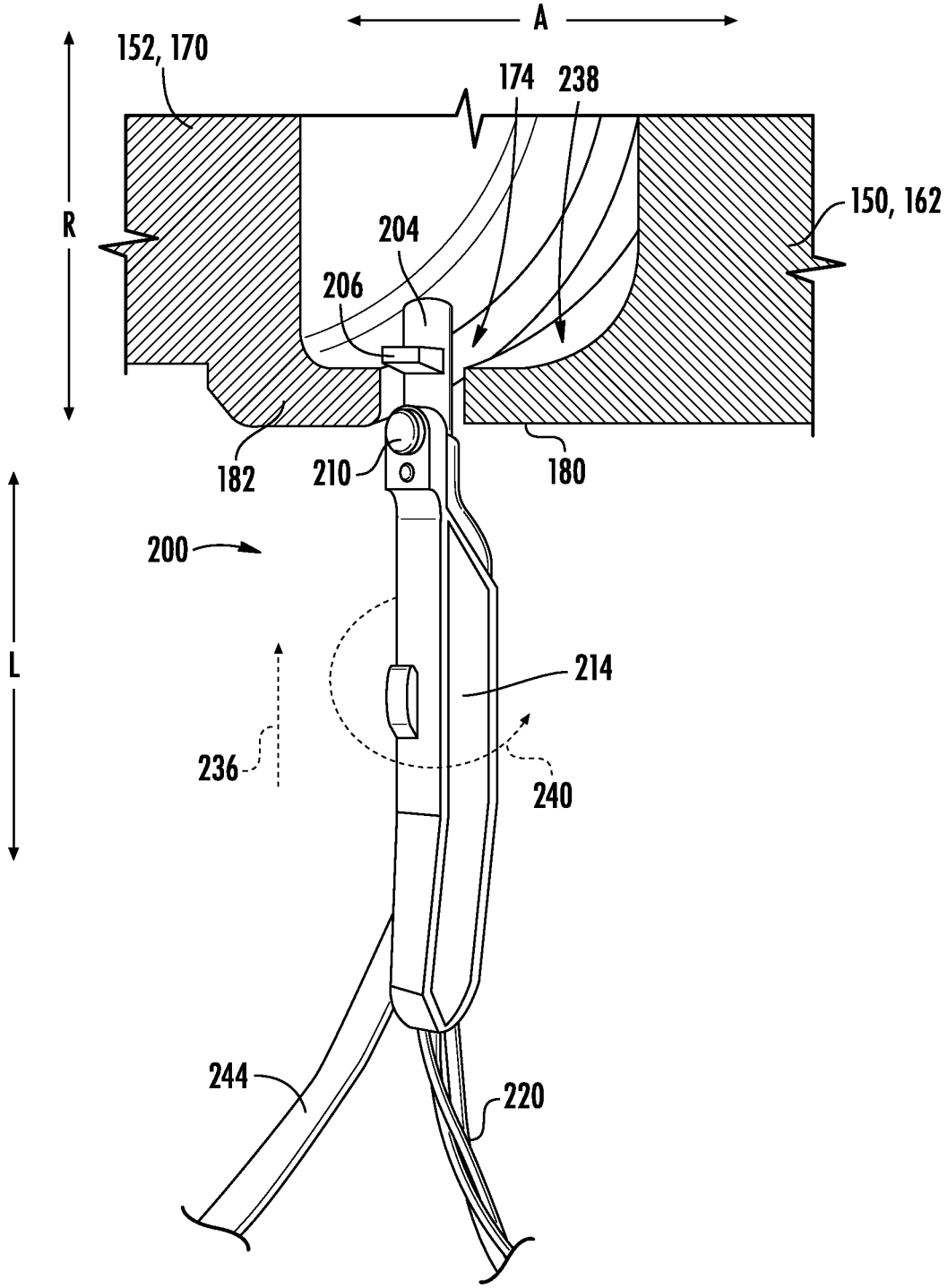
FIG. 9 is a view of the exemplary tool of FIG. 3 being inserted into an axial gap of an engine in accordance with an exemplary embodiment of the present disclosure in a first circumferential orientation.
Figure 10:
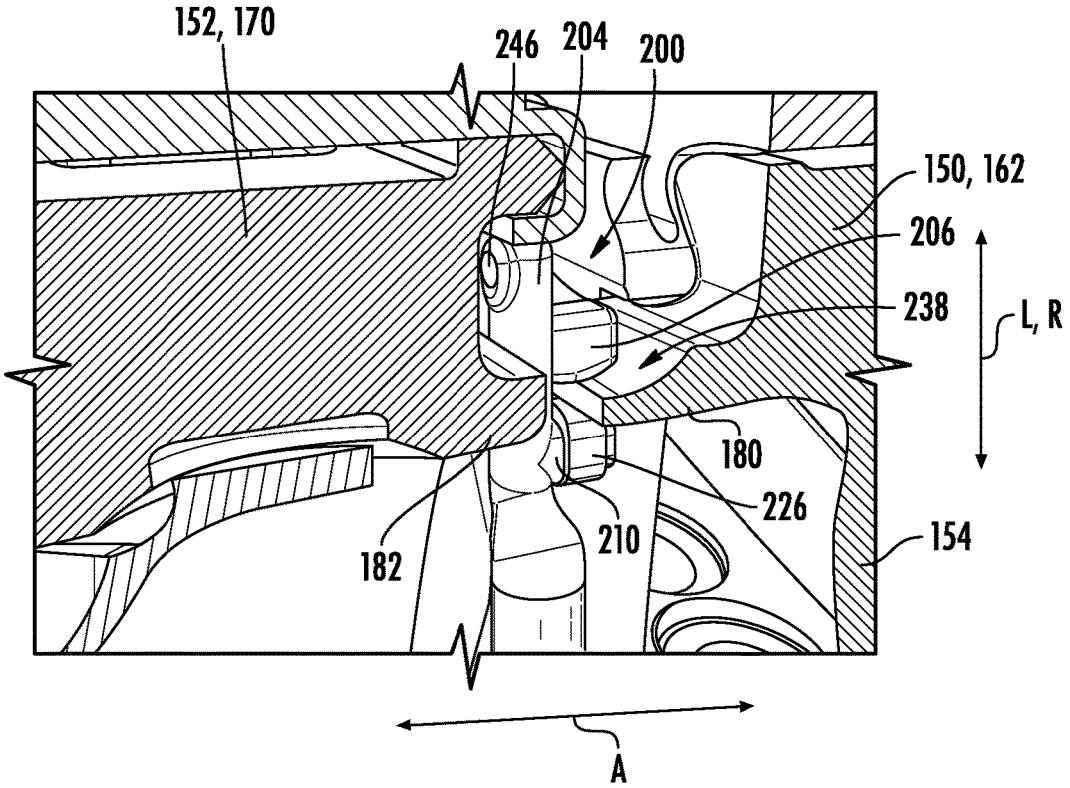
FIG. 10 is a view of the exemplary tool of FIG. 3 positioned within the axial gap of the exemplary engine of FIG. 9 in a second circumferential orientation.

Referring now to FIGS. 9 and 10, an exemplary operation of the exemplary tool 200 described above will be described in more detail. FIG. 9 provides a view of the tool 200 being inserted into an axial gap 174 of an engine while in the insertion position, and FIG. 10 provides a view of the tool 200 positioned at least partially within the axial gap 174 and mounted to a component of an engine.

Specifically, the views of FIGS. 9 and 10 show the tool 200 relative to an axial gap 174 of an engine (see also FIG. 2 for exemplary schematic view). For example, in certain exemplary embodiments, the engine may include a stage of rotor blades 150 adjacent to a stage of stator vanes 152. The stage of rotor blades 150 may include a plurality of turbine airfoils 154, with each turbine airfoil 154 coupled to or formed with a rotor platform 162 at a radial inner end 160. Similarly, the stage of stator vanes 152 may include a plurality of stator airfoils 165, with each stator airfoil 165 coupled to or formed with a stator platform 170 at a radial inner end 172. The rotor platform 162 includes an end portion 180 along the axial direction A, and the stator platform 170 similarly includes an end portion 182 along the axial direction A. The end portions 180, 182 of the rotor platform 162 and stator platform 170 define the axial gap 174.

The exemplary tool 200 described herein may be capable of inspecting various components inward of the rotor platform 162, the stator platform 170, or both along the radial direction R, and further may be capable of performing one or more maintenance activities on various components inward of the rotor platform 162, the stator platform 170, or both along the radial direction R. In order to perform such inspection and/or maintenance activities, the tool 200 is configured to clamp on to the end portion of the rotor platform 162.

More specifically, referring in particular to FIG. 9, the tool 200 may be inserted at least partially into the axial gap 174 by moving the tool 200 generally along the radial direction R of the engine with the pivot member 214 of the tool 200 in the insertion position. Such movement is noted by the phantom line 236 in FIG. 9. In such a manner, it will be appreciated, that the maximum thickness 234 of the base 202 of the tool 200 (see FIG. 6) may be less than a measure of the axial gap 174 along the axial direction A, whereas the maximum width 232 of the base 202 of the tool 200 (see FIG. 6) may be larger than the axial gap 174. Further, in such a manner, once the base 202 of the tool 200 is positioned at least partially within or through the axial gap 174, such that the first extension member 206 of the body 204 of the base 202 is proximate a radial inner side 238 of the rotor platform 162, the tool 200 may be rotated in a circumferential direction C of the tool 200 (i.e., a direction extending about the longitudinal direction L), as is indicated by phantom line 240 in FIG. 9, such that the first extension member 206 and the second extension member 210 are positioned on opposing radial sides of the end portion 180 of the rotor platform 162.

Figure 11:
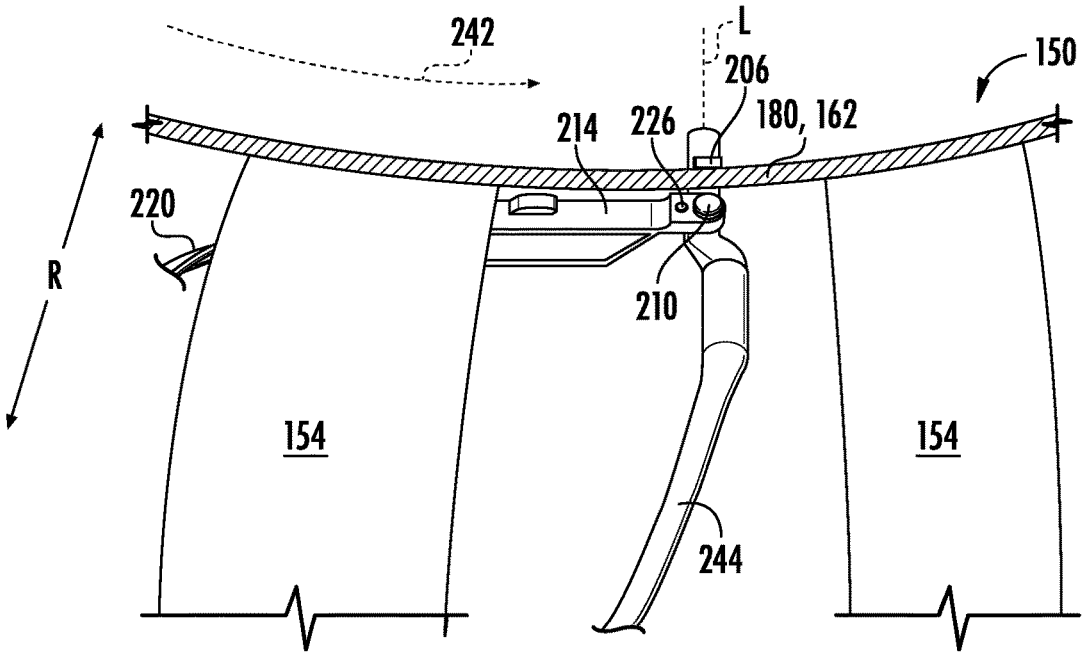
FIG. 11 is a schematic view of the tool of FIG. 3 coupled to a rotor platform of the exemplary engine of FIG. 9.

Referring now briefly to FIG. 11, providing a view of the tool 200 mounted to the end portion 180 of the rotor platform 162 within the engine, it will be appreciated that in order to further secure the tool 200 to the end portion of the rotor platform 162, the pivot member 214 may be moved to the deployed position, such that the sleeve 226 of the pivot member 214 closes a gap with the first extension member 206, clamping the tool 200 on to the end portion 180 of the rotor platform 162. In at least certain embodiments, the pivot member 214 may be moved to the deployed position by maintaining a tension on the cable 220 extending from the pivot member 214, the pivot member implement 218, or both, while at the same time rotating the stage of rotor blades 150 in the circumferential direction of the engine, as is indicated by phantom line 242.

As is shown in the various figures discussed herein above, it will be appreciated that the tool 200 further includes a flexible member 244 extending from the base 202 of the tool 200. The flexible member 244 may provide for the application of the torsional force on the base 202 of the tool 200 to move the base 202 of the tool 200 in the circumferential direction (see phantom line 240) of the base 202 once positioned at least partially through the axial gap 174 of the engine to position the first extension member 206 and a second extension member 210 on opposing sides of the end portion 180 of the rotor platform 162. Notably, however, the flexible member 244 may have sufficient flexibility in bending to allow for the tool 200 to be moved with the stage of rotor blades 150 in the circumferential direction of the engine (in the direction of phantom line 242).

In at least certain exemplary embodiments, the flexible member 244 may be formed of, e.g., a nylon material to provide sufficient torsional stiffness while still allowing a desired flexibility. However, in other embodiments, any other suitable material may be provided.

Referring back to FIG. 10, it will further be appreciated that the base 202 includes a base implement 246 located on the body 204 of the tool 200. For the embodiment shown, the base implement 246 is positioned opposite the body 204 than first and second extension member 206, 210. The base implement 246 may be utilized to perform one or more maintenance activities or operations once the tool 200 is coupled to (e.g., clamped onto) the rotor platform 162. It will be appreciated, that as used herein, the term maintenance activities refers broadly to any activities that add material to a component, remove material from a component, or change one or more properties of the material of a component. As such, it will be appreciated that the base implement 246 may be configured as one or more of a nozzle for spraying a coating on a component, a nozzle for spraying a cleaning material on a component, a mechanical implement for removing material from a component or adding material to a component, an implement for applying relatively high temperatures to a component, or the like. In one or more these embodiments, the flexible member 244 may be configured to provide consumable material to the base implement 246 or other fluids to facilitate operation of the base implement 246.

Additionally, or alternatively, it will be appreciated that once the tool 200 is installed/attached to the rotor platform 162, the pivot member 214 may provide for inspection of one or more components inward along the radial direction R of the rotor platform 162, the stator platform 170, or both. For example, referring back briefly to FIG. 6, it will be appreciated that the camera 222 may allow a user to first inspect the various components inward of the rotor platform 162, the stator platform 170, or both and then perform any maintenance operations as may be necessary in response to the inspection results using the base implement 246.

It will be appreciated, however, that the exemplary tool 200 described above with reference to FIGS. 3 through 11 is provided by way of example only. In other exemplary embodiments, the tool 200 may have any other suitable configuration to facilitate inspection and/or maintenance of one or more components positioned at, or positioned radially inward of, a rotor platform 162, a stator platform 170, or both.

For example, in other exemplary embodiments, the tool 200 may not include a pivot member 214, and instead may be configured such that the second extension member 210 directly contacts the rotor platform 162. With such a configuration, a stand-alone sleeve may optionally be positioned on the second extension member to provide a desired clamping. With such a configuration, the tool 200 may be configured to continuously spray, e.g., a cleaner to the radial inward location using the base implement 246.

Additionally, or alternatively, in other embodiments, the pivot member 214, if included, may have any other suitable pivot member implement 218. For example, although for the embodiment shown, the pivot member implement 218 includes a camera 222 and one or more light sources 224, in other embodiments, the pivot member implement 218 may include one or more features for performing maintenance operations.

Additionally, or alternatively, still, in other exemplary embodiments, the base 202 may include any other suitable base implement 246, or may not include a base implement 246 at all. For example, in other exemplary embodiments, the base implement 246 may be an implement for inspecting, such as a camera, one or more light sources, or both.

Additionally, although the exemplary base implement 246 shown is positioned opposite the first and second extension members 206, 210, in other embodiments, in other exemplary embodiments, the base implement 246, if included, may be positioned at any other suitable orientation.

Figure 12:
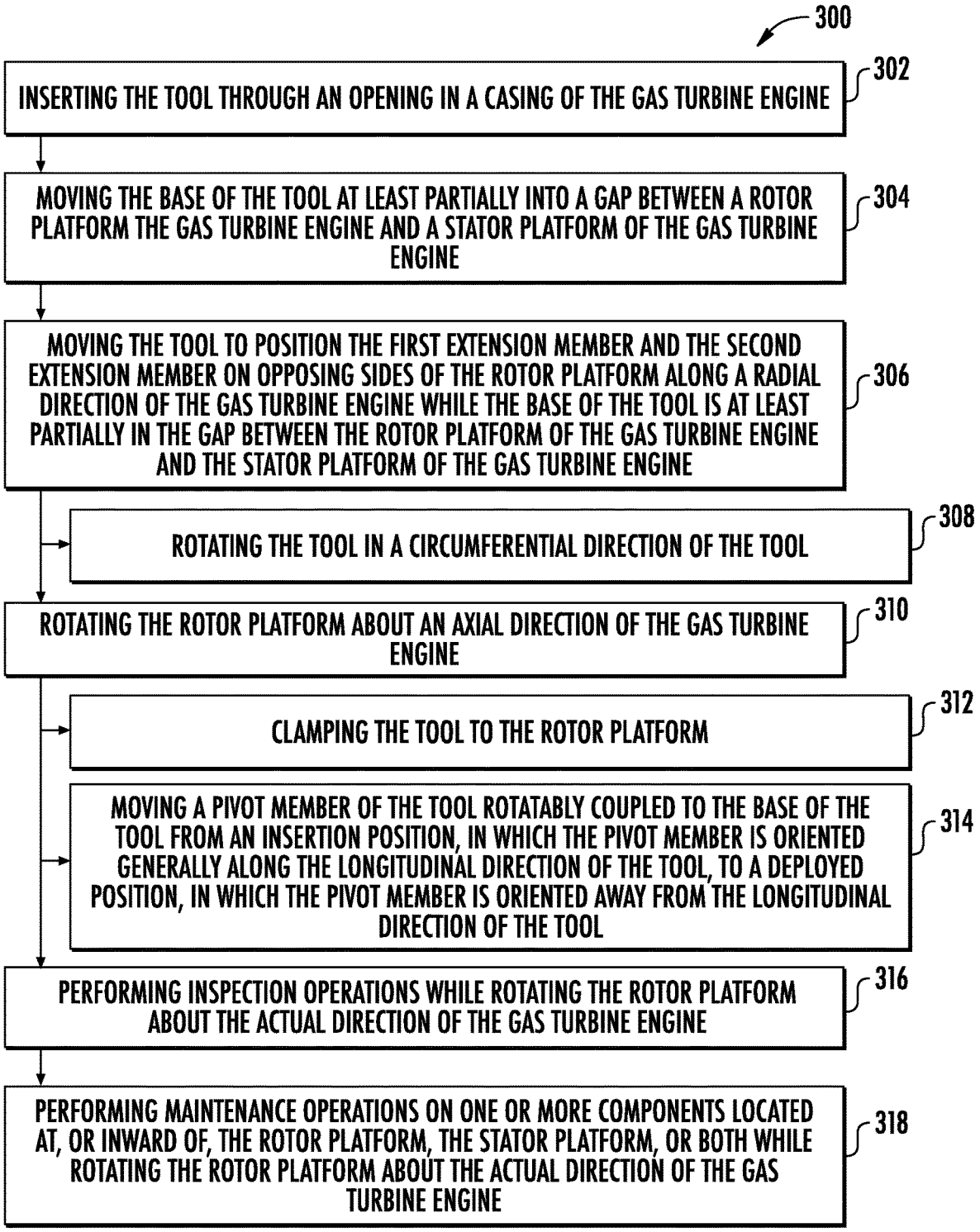
FIG. 12 is a flow diagram of a method for performing an inspection or maintenance operation in accordance with an exemplary aspect of the present disclosure.

Referring now to FIG. 12, a method 300 is provided for performing an inspection or maintenance operation on a gas turbine engine. The method 300 may utilize one or more of the exemplary tools described above with reference to FIGS. 3 through 11. However, in other embodiments, any other suitable tool may be utilized.

The method 300 includes at (302) inserting the tool through an opening in a casing of the gas turbine engine. The casing may be an outer casing of the gas turbine engine, a flowpath casing/liner of the gas turbine engine, or both. The tool defines a longitudinal direction and a tangential direction and includes a base extending along the longitudinal direction. The base includes a body, a first extension member extending from the body and the tangential direction, and a second extension member extending from the body in the tangential direction.

The method 300 further includes at (304) moving the base of the tool at least partially into a gap between a rotor platform the gas turbine engine and a stator platform of the gas turbine engine. The gap may be an axial gap. Additionally, the method 300 includes at (306) moving the tool to position the first extension member and the second extension member on opposing sides of the rotor platform along a radial direction of the gas turbine engine while the base of the tool is at least partially in the gap between the rotor platform of the gas turbine engine and the stator platform of the gas turbine engine.

For the exemplary embodiment depicted, moving the tool to position the first extension member and the second extension member on opposing sides of the rotor platform at (306) may include at (308) rotating the tool in a circumferential direction of the tool. The circumferential direction of the tool is defined about the longitudinal direction of the tool. In such a manner, it will be appreciated that the tool may be inserted into the gap between the rotor and stator platforms while in a first circumferential orientation such that the first extension member is oriented along a length of the gap, and subsequently may be moved to a second circumferential orientation such that the first extension member is oriented perpendicularly to the length of the gap.

Referring still to FIG. 12, the exemplary method 300 further includes at (310) rotating the rotor platform about an axial direction of the gas turbine engine. For the embodiment shown, rotating the rotor platform about the axial direction of the gas turbine engine at (310) includes at (312) clamping the tool to the rotor platform. Specifically, for the embodiment shown, rotating the rotor platform about the axial direction of the gas turbine engine at (310) includes at (314) moving a pivot member of the tool rotatably coupled to the base of the tool from an insertion position, in which the pivot member is oriented generally along the longitudinal direction of the tool, to a deployed position, in which the pivot member is oriented away from the longitudinal direction of the tool.

Further, the exemplary method 300 includes at (316) performing inspection operations while rotating the rotor platform about the actual direction of the gas turbine engine, and at (318) performing maintenance operations on one or more components located at, or inward of, the rotor platform, the stator platform, or both while rotating the rotor platform about the actual direction of the gas turbine engine.

By way of example, one operation that may utilize one or more of the exemplary embodiments and aspects described herein is to provide an adhesive retention to a component located inward of a core air flowpath of an engine along a radial direction R, such as inward of a rotor platform 162 and a stator platform 170. For example, the operation may be to provide an adhesive retention to a pin in situ for the purpose of changing a vibratory response of the pin during operation of the engine. In such a case, the tool 200 may be inserted through the core air flowpath and through a gap between a rotor platform 162 and an adjacent stator platform 170. The tool 200 may then be rotated in a circumferential direction (about a longitudinal direction of the tool) and the rotor (including the rotor platform 162) may be rotated in a circumferential direction of the engine, locking the tool 200 onto the rotor platform 162. The tool 200 may then identify a pin coupled to the adjacent stator assembly (or some other stationary part of the engine located inward of the core air flowpath and adjacent to the rotor) using a camera 222, and optionally spray the pin with a cleaning solution (such as one or more solvents) and dry the pin with, e.g., an acetone and air mixture or combination. Such may be accomplished using a base implement 246 configured as a spray nozzle. The tool 200 may then apply an adhesive or other additive onto the pin. Certain of such steps may be repeated for multiple components spaced circumferentially on the stationary component.

It will be appreciated, however, that in other embodiments, any other suitable repair process may be undertaken on any other suitable components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects of the invention are provided by the subject matter of the following clauses:

A tool for performing inspection and/or maintenance operations on an engine, the tool defining a longitudinal direction and a tangential direction, the tool comprising: a base extending along the longitudinal direction and comprising a body, a first extension member extending from the body in the tangential direction at a first location, and a second extension member extending from the body in the tangential direction at a second location, the second location spaced from the first location along the longitudinal direction; and a pivot member rotatably coupled to the base and moveable between an insertion position in which the pivot member is oriented generally along the longitudinal direction and a deployed position in which the pivot member is oriented away from the longitudinal direction.

The tool of one or more of the previous clauses, wherein the pivot member is rotatably coupled to the second extension member of the base.

The tool of one or more of the previous clauses, wherein the pivot member comprises a sleeve extending at least partially around the second extension member to rotatably couple the pivot member to the second extension member.

The tool of one or more of the previous clauses, wherein the sleeve defines a first gap with the first extension member along the longitudinal direction when the pivot member is in the insertion position and a second gap with the first extension member along the longitudinal direction when the pivot member is in the deployed position, wherein the first gap is greater than the second gap.

The tool of one or more of the previous clauses, wherein the base of the tool defines a maximum width along the tangential direction and a maximum thickness in a direction perpendicular to the tangential direction and the longitudinal direction, wherein the maximum thickness is less than the maximum width.

The tool of one or more of the previous clauses, wherein the pivot member comprises an implement, and wherein the tool further comprises a wire extending from the pivot member, the implement, or both and unconnected from the base of the tool.

The tool of one or more of the previous clauses, wherein the implement comprises a camera, a light source, or both.

The tool of one or more of the previous clauses, further comprising: a flexible member extending from the base of the tool for applying a torsional force on the base of the tool.

The tool of one or more of the previous clauses, wherein the first and second extension members of the tool are configured to clamp on to a component of a rotatable part of the engine when the pivot member is moved to the deployed position.

The tool of one or more of the previous clauses, wherein the pivot member defines a first angle less than 30 degrees with the longitudinal direction when in the insertion position and a second angle greater than 30 degrees with the longitudinal direction when in the deployed position.

The tool of one or more of the previous clauses, wherein the base comprises an implement located on the body opposite the first and second extension members.

A gas turbine engine defining an axial direction and a radial direction, the gas turbine engine comprising: a stage of rotor blades comprising a rotor platform, the rotor platform comprising an end portion along the axial direction; and a tool for performing inspection and/or maintenance operations within the gas turbine engine, the tool comprising a base, the base comprising an implement, the tool attachable to the end portion of the rotor platform.

The gas turbine engine of one or more of the previous clauses, wherein the tool defines a longitudinal direction and a tangential direction, wherein the base extends along the longitudinal direction and comprises a body, a first extension member extending from the body in the tangential direction, and a second extension member extending from the body in the tangential direction, wherein the tool is moveable to an attached position on the end portion of the rotor platform to attach the tool to the end portion of the rotor platform, wherein the first extension member and the second extension member are positioned on opposing sides of the rotor platform along the radial direction of the gas turbine engine when moved to the attached position.

The gas turbine engine of one or more of the previous clauses, further comprising: a stage of stator vanes positioned adjacent to the stage of rotor blades, the stage of stator vanes comprising a stator platform, the stator platform comprising an end portion along the axial direction defining an axial gap with the end portion of the rotor platform; wherein the base of the tool defines a maximum width along the tangential direction and a maximum thickness in a direction perpendicular to the tangential direction and the longitudinal direction, wherein the maximum thickness is less than the axial gap and wherein the maximum width is larger than the axial gap.

The gas turbine engine of one or more of the previous clauses, wherein the tool further comprises a pivot member rotatably coupled to the second extension member of the base and moveable between an insertion position in which the pivot member is oriented generally along the longitudinal direction and a deployed position in which the pivot member is oriented away from the longitudinal direction.

The gas turbine engine of one or more of the previous clauses, wherein the implement is located on the body opposite the first and second extension members.

A method for performing an inspection or maintenance operation on a gas turbine engine, the method comprising: inserting a tool through an opening in a casing of the gas turbine engine, the tool defining a longitudinal direction and a tangential direction and comprising a base extending along the longitudinal direction, the base comprising a body, a first extension member extending from the body in the tangential direction, and a second extension member extending from the body in the tangential direction; moving the base of the tool at least partially into a gap between a rotor platform of the gas turbine engine and a stator platform of the gas turbine engine; and moving the tool to position the first extension member and the second extension member on opposing sides of the rotor platform along a radial direction of the gas turbine engine while the base of the tool is at least partially in the gap between the rotor platform of the gas turbine engine and the stator platform of the gas turbine engine.

The method of one or more of the previous clauses, wherein moving the tool to position the first extension member and the second extension member on opposing sides of the rotor platform comprises rotating the tool in a circumferential direction of the tool, the circumferential direction of the tool defined about the longitudinal direction of the tool.

The method of one or more of the previous clauses, further comprising: rotating the rotor platform about an axial direction of the gas turbine engine, wherein rotating the rotor platform about the axial direction comprises clamping the tool to the rotor platform.

The method of one or more of the previous clauses, further comprising: rotating the rotor platform about an axial direction of the gas turbine engine, wherein rotating the rotor platform about the axial direction comprises moving a pivot member rotatably coupled to the base and from an insertion position, in which the pivot member is oriented generally along the longitudinal direction of the tool, to a deployed position, in which the pivot member is oriented away from the longitudinal direction of the tool.

What is claimed is:

1. A tool for performing inspection and/or maintenance operations on an engine, the tool defining a longitudinal direction and a tangential direction, the tool comprising:

a base extending along the longitudinal direction and comprising a body, a first extension member extending from the body in the tangential direction at a first location, and a second extension member extending from the body in the tangential direction at a second location, the second location spaced from the first location along the longitudinal direction; and a pivot member rotatably coupled to the base and moveable between an insertion position in which the pivot member is oriented generally along the longitudinal direction and a deployed position in which the pivot member is oriented away from the longitudinal direction, wherein the pivot member comprises an implement, and wherein the tool further comprises a wire extending from the pivot member, the implement, or both and the wire being unconnected from the base of the tool.

2. The tool of claim 1, wherein the pivot member is rotatably coupled to the second extension member of the base.

3. The tool of claim 2, wherein the pivot member comprises a sleeve extending at least partially around the second extension member to rotatably couple the pivot member to the second extension member.

4. The tool of claim 3, wherein the sleeve defines a first gap with the first extension member along the longitudinal direction when the pivot member is in the insertion position and a second gap with the first extension member along the longitudinal direction when the pivot member is in the deployed position, wherein the first gap is greater than the second gap.

5. The tool of claim 1, wherein the base of the tool defines a maximum width along the tangential direction and a maximum thickness in a direction perpendicular to the tangential direction and the longitudinal direction, wherein the maximum thickness is less than the maximum width.

6. The tool of claim 1, wherein the implement comprises a camera, a light source, or both.

7. The tool of claim 1, further comprising:

a flexible member extending from the base of the tool for applying a torsional force on the base of the tool.

8. The tool of claim 1, wherein the first extension member and the second extension member of the tool are configured to clamp on to a component of a rotatable part of the engine when the pivot member is moved to the deployed position.

9. The tool of claim 1, wherein the pivot member defines a first angle less than 30 degrees with the longitudinal direction when in the insertion position and a second angle greater than 30 degrees with the longitudinal direction when in the deployed position.

10. A method for performing an inspection or maintenance operation on a gas turbine engine, the method comprising:

inserting a tool through an opening in a casing of the gas turbine engine, the tool defining a longitudinal direction and a tangential direction and comprising a base extending along the longitudinal direction, the base comprising a body, a first extension member extending from the body in the tangential direction at a first location, and a second extension member extending from the body in the tangential direction at a second location, the second location spaced from the first location along the longitudinal direction, and a pivot member rotatably coupled to the base and moveable between an insertion position in which the pivot member is oriented generally along the longitudinal direction and a deployed position in which the pivot member is oriented away from the longitudinal direction, wherein the pivot member comprises an implement, and wherein the tool further comprises a wire extending from the pivot member, the implement, or both and the wire being unconnected from the base of the tool;

moving the base of the tool at least partially into a gap between a rotor platform of the gas turbine engine and a stator platform of the gas turbine engine; and moving the tool to position the first extension member and the second extension member on opposing sides of the rotor platform along a radial direction of the gas turbine engine while the base of the tool is at least partially in the gap between the rotor platform of the gas turbine engine and the stator platform of the gas turbine engine.

11. The method of claim 10, wherein moving the tool to position the first extension member and the second extension member on opposing sides of the rotor platform comprises rotating the tool in a circumferential direction of the tool, the circumferential direction of the tool defined about the longitudinal direction of the tool.

12. The method of claim 10, further comprising:

rotating the rotor platform about an axial direction of the gas turbine engine, wherein rotating the rotor platform about the axial direction comprises clamping the tool to the rotor platform.

13. The method of claim 10, further comprising:

rotating the rotor platform about an axial direction of the gas turbine engine, wherein rotating the rotor platform about the axial direction comprises moving the pivot member rotatably coupled to the base and from the insertion position, in which the pivot member is oriented generally along the longitudinal direction of the tool, to the deployed position, in which the pivot member is oriented away from the longitudinal direction of the tool.

* * * * *